US011396787B2

(12) United States Patent
Kellner et al.

(10) Patent No.: US 11,396,787 B2
(45) Date of Patent: Jul. 26, 2022

(54) DOWNHOLE TOOL WITH BALL-IN-PLACE SETTING ASSEMBLY AND ASYMMETRIC SLEEVE

(71) Applicant: INNOVEX DOWNHOLE SOLUTIONS, INC., Houston, TX (US)

(72) Inventors: Justin Kellner, Adkins, TX (US); Nick Tonti, The Woodlands, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 363 days.

(21) Appl. No.: 16/366,470

(22) Filed: Mar. 27, 2019

(65) Prior Publication Data

US 2020/0256150 A1 Aug. 13, 2020

Related U.S. Application Data

(60) Provisional application No. 62/804,046, filed on Feb. 11, 2019.

(51) Int. Cl.

| | |
|---|---|
| ***E21B 33/12*** | (2006.01) |
| ***E21B 23/04*** | (2006.01) |
| *E21B 23/06* | (2006.01) |

(52) U.S. Cl.
CPC ..... *E21B 33/12* (2013.01); *E21B 23/04* (2013.01); *E21B 23/06* (2013.01)

(58) Field of Classification Search
CPC ..... E21B 23/04; E21B 23/0413; E21B 33/12
See application file for complete search history.

(56) References Cited

U.S. PATENT DOCUMENTS

| | | | |
|---|---|---|---|
| 2,189,697 | A | 2/1940 | Baker |
| 2,222,233 | A | 11/1940 | Mize |
| 2,225,143 | A | 12/1940 | Baker et al. |

(Continued)

FOREIGN PATENT DOCUMENTS

| | | | |
|---|---|---|---|
| AR | 091776 | A1 | 2/2015 |
| AU | 2010214651 | A1 | 3/2012 |

(Continued)

OTHER PUBLICATIONS

Anjum et al., Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way, SPE International Oil & Gas Conference, Jun. 8-10, 2010, pp. 1-16.

(Continued)

*Primary Examiner* — Robert E Fuller
*Assistant Examiner* — Lamia Quaim
(74) *Attorney, Agent, or Firm* — MH2 Technology Law Group LLP

(57) ABSTRACT

A downhole tool system includes a downhole tool. The downhole tool includes a body having a bore formed axially-therethrough. An inner surface of the body defines an asymmetric shoulder. The downhole tool also includes an upper cone configured to be received within the bore of the body from an upper axial end of the body. The upper cone is configured to move within the body in a first direction from the upper axial end toward the shoulder in response to actuation by a setting assembly, which forces at least a portion of the body radially-outward.

23 Claims, 7 Drawing Sheets

(56) References Cited

U.S. PATENT DOCUMENTS 3,127,198 A 3/1964 Orund
3,746,093 A 7/1973 Mullins
3,860,067 A 1/1975 Rodgers
4,155,404 A 5/1979 Hollingsworth
4,483,399 A 11/1984 Colgate
4,901,794 A 2/1990 Baugh et al.
5,064,164 A 11/1991 Le
5,131,468 A 7/1992 Lane et al.
5,325,923 A 7/1994 Surjaatmadja et al.
5,396,957 A 3/1995 Surjaatmadja et al.
5,479,986 A 1/1996 Gano et al.
5,542,473 A 8/1996 Pringle
5,623,993 A 4/1997 Buskirk et al.
5,701,959 A 12/1997 Hushbeck et al.
5,709,269 A 1/1998 Head
5,984,007 A 11/1999 Yuan et al.
6,167,963 B1 1/2001 McMahan et al.
6,220,349 B1 4/2001 Vargus et al.
6,296,054 B1 10/2001 Kunz et al.
6,354,372 B1 3/2002 Carisella et al.
6,354,373 B1 3/2002 Vercaemer et al.
6,446,323 B1 9/2002 Metcalfe et al.
6,581,681 B1 6/2003 Zimmerman et al.
6,662,876 B2 12/2003 Lauritzen
6,684,958 B2 2/2004 Williams et al.
6,695,050 B2 2/2004 Winslow et al.
6,702,029 B2 3/2004 Metcalfe et al.
6,712,153 B2 3/2004 Turley et al.
6,722,437 B2 4/2004 Vercaemer et al.
6,793,022 B2 9/2004 Vick et al.
6,796,376 B2 9/2004 Frazier
6,796,534 B2 9/2004 Beyer et al.
7,048,065 B2 5/2006 Badrak et al.
7,093,656 B2 8/2006 Maguire
7,096,938 B2 8/2006 Carmody et al.
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Abercrombie Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Hailey, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,614,448 B2 11/2009 Swagerty et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
7,980,300 B2 7/2011 Roberts et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,776 B2 3/2015 Spray
8,991,485 B2 3/2015 Chenault et al.
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,228,404 B1 1/2016 Jackson et al.
9,309,733 B2 4/2016 Xu et al.
9,334,702 B2 5/2016 Allen et al.
9,382,790 B2 7/2016 Bertoja et al.
D762,737 S 8/2016 Fitzhugh
D763,324 S 8/2016 Fitzhugh
9,470,060 B2 10/2016 Young
9,574,415 B2 2/2017 Xu et al.
9,605,508 B2 3/2017 Xu et al.
D783,133 S 4/2017 Fitzhugh
9,752,423 B2 9/2017 Lynk
9,835,003 B2 12/2017 Harris
D807,991 S 1/2018 Fitzhugh
9,909,384 B2 3/2018 Chauffe et al.
9,927,058 B2 3/2018 Sue
9,976,379 B2 5/2018 Schmidt
9,976,381 B2 5/2018 Martin et al.
D827,000 S 8/2018 Van Lue
10,156,119 B2 12/2018 Martin et al.
10,400,531 B2 9/2019 Jackson et al.
10,408,012 B2 9/2019 Martin et al.
10,415,336 B2 9/2019 Benzie
10,533,392 B2 1/2020 Walton
10,605,018 B2 3/2020 Schmidt
10,648,275 B2 5/2020 Dirocco
10,920,523 B2 2/2021 Kellner et al.
2003/0062171 A1 4/2003 Maguire et al.
2003/0099506 A1 5/2003 Mosing
2003/0188876 A1 10/2003 Vick et al.
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0189103 A1 9/2005 Roberts et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.

(56) References Cited

U.S. PATENT DOCUMENTS

| | | | |
|---|---|---|---|
| 2006/0272828 | A1 | 12/2006 | Manson |
| 2007/0000664 | A1 | 1/2007 | Ring et al. |
| 2007/0044958 | A1 | 3/2007 | Rytlewski et al. |
| 2007/0272418 | A1 | 11/2007 | Corre et al. |
| 2008/0066923 | A1 | 3/2008 | Xu |
| 2008/0073074 | A1 | 3/2008 | Frazier |
| 2008/0135248 | A1 | 6/2008 | Talley et al. |
| 2008/0135261 | A1 | 6/2008 | McGilvray et al. |
| 2008/0142223 | A1 | 6/2008 | Xu et al. |
| 2008/0190600 | A1 | 8/2008 | Shkurti et al. |
| 2008/0264627 | A1 | 10/2008 | Roberts et al. |
| 2008/0308266 | A1 | 12/2008 | Roberts et al. |
| 2009/0044949 | A1 | 2/2009 | King et al. |
| 2009/0065192 | A1 | 3/2009 | Lucas |
| 2009/0065196 | A1 | 3/2009 | Holland et al. |
| 2009/0205843 | A1 | 8/2009 | Gandikota et al. |
| 2009/0242213 | A1 | 10/2009 | Braddick |
| 2009/0266560 | A1 | 10/2009 | Ring et al. |
| 2010/0032167 | A1 | 2/2010 | Adam et al. |
| 2010/0038072 | A1 | 2/2010 | Akselberg |
| 2010/0116489 | A1 | 5/2010 | Nelson |
| 2010/0132960 | A1 | 6/2010 | Shkurti et al. |
| 2010/0170682 | A1 | 7/2010 | Brennan, III |
| 2010/0263857 | A1 | 10/2010 | Frazier |
| 2010/0270031 | A1 | 10/2010 | Patel |
| 2010/0270035 | A1 | 10/2010 | Ring et al. |
| 2010/0276159 | A1 | 11/2010 | Mailand et al. |
| 2010/0314127 | A1 | 12/2010 | Swor et al. |
| 2010/0319427 | A1 | 12/2010 | Lohbeck |
| 2010/0319927 | A1 | 12/2010 | Yokley et al. |
| 2011/0005779 | A1 | 1/2011 | Lembcke |
| 2011/0048743 | A1 | 3/2011 | Stafford et al. |
| 2011/0088891 | A1 | 4/2011 | Stout |
| 2011/0132143 | A1 | 6/2011 | Xu et al. |
| 2011/0132619 | A1 | 6/2011 | Agrawal et al. |
| 2011/0132621 | A1 | 6/2011 | Agrawal et al. |
| 2011/0132623 | A1 | 6/2011 | Moeller |
| 2011/0232899 | A1 | 9/2011 | Porter |
| 2011/0240295 | A1 | 10/2011 | Porter et al. |
| 2011/0266004 | A1 | 11/2011 | Hallundbaek et al. |
| 2011/0284232 | A1 | 11/2011 | Huang |
| 2012/0024109 | A1 | 2/2012 | Xu et al. |
| 2012/0055669 | A1 | 3/2012 | Levin et al. |
| 2012/0067583 | A1 | 3/2012 | Zimmerman et al. |
| 2012/0097384 | A1 | 4/2012 | Valencia |
| 2012/0111566 | A1 | 5/2012 | Sherman et al. |
| 2012/0118583 | A1 | 5/2012 | Johnson et al. |
| 2012/0132426 | A1 | 5/2012 | Xu et al. |
| 2012/0168163 | A1 | 7/2012 | Bertoja et al. |
| 2012/0199341 | A1 | 8/2012 | Kellner et al. |
| 2012/0205873 | A1 | 8/2012 | Turley |
| 2012/0247767 | A1 | 10/2012 | Themig et al. |
| 2012/0273199 | A1 | 11/2012 | Cresswell et al. |
| 2013/0008671 | A1 | 1/2013 | Booth |
| 2013/0062063 | A1 | 3/2013 | Baihly et al. |
| 2013/0081825 | A1 | 4/2013 | Lynde et al. |
| 2013/0186615 | A1 | 7/2013 | Hallubaek et al. |
| 2013/0186616 | A1 | 7/2013 | Xu et al. |
| 2013/0192853 | A1 | 8/2013 | Themig |
| 2013/0299185 | A1 | 11/2013 | Xu et al. |
| 2014/0014339 | A1 | 1/2014 | O'Malley et al. |
| 2014/0076571 | A1 | 3/2014 | Frazier et al. |
| 2014/0131054 | A1 | 5/2014 | Raynal |
| 2014/0209325 | A1 | 7/2014 | Dockweiler |
| 2014/0224477 | A1 | 8/2014 | Wiese |
| 2014/0238700 | A1 | 8/2014 | Williamson |
| 2014/0262214 | A1 | 9/2014 | Mhaskar |
| 2014/0352970 | A1 | 12/2014 | Kristoffer |
| 2015/0027737 | A1 | 1/2015 | Rochen |
| 2015/0068757 | A1 | 3/2015 | Hofman et al. |
| 2015/0075774 | A1 | 3/2015 | Raggio |
| 2015/0129215 | A1 | 5/2015 | Xu et al. |
| 2015/0184485 | A1 | 7/2015 | Xu et al. |
| 2015/0218904 | A1 | 8/2015 | Chauffe et al. |
| 2016/0160591 | A1 | 6/2016 | Xu |
| 2016/0186511 | A1 | 6/2016 | Coronado et al. |
| 2016/0290096 | A1 | 10/2016 | Tse |
| 2016/0305215 | A1 | 10/2016 | Harris et al. |
| 2016/0312557 | A1 | 10/2016 | Kitzman |
| 2016/0333655 | A1 | 11/2016 | Fripp |
| 2016/0376869 | A1 | 12/2016 | Rochen |
| 2017/0022781 | A1 | 1/2017 | Martin |
| 2017/0067328 | A1 | 3/2017 | Chauffe |
| 2017/0101843 | A1 | 4/2017 | Waterhouse et al. |
| 2017/0130553 | A1 | 5/2017 | Harris |
| 2017/0146177 | A1 | 5/2017 | Sue |
| 2017/0218711 | A1 | 8/2017 | Kash |
| 2017/0260824 | A1 | 9/2017 | Kellner |
| 2017/0370176 | A1 | 12/2017 | Frazier |
| 2018/0030807 | A1* | 2/2018 | Martin ..... E21B 33/1208 |
| 2018/0073325 | A1 | 3/2018 | Dolog |
| 2018/0087345 | A1 | 3/2018 | Xu |
| 2018/0266205 | A1 | 9/2018 | Martin |
| 2018/0363409 | A1 | 12/2018 | Frazier |
| 2019/0063179 | A1 | 2/2019 | Murphy |
| 2019/0106961 | A1 | 4/2019 | Hardesty |
| 2019/0203556 | A1 | 7/2019 | Powers |
| 2019/0264513 | A1 | 8/2019 | Kosel |
| 2019/0292874 | A1 | 9/2019 | Saeed |
| 2020/0072019 | A1 | 3/2020 | Tonti |
| 2020/0131882 | A1 | 4/2020 | Tonti |
| 2020/0173246 | A1 | 6/2020 | Kellner |
| 2020/0248521 | A1 | 8/2020 | Southard |
| 2020/0256150 | A1 | 8/2020 | Kellner |

FOREIGN PATENT DOCUMENTS

| | | | |
|---|---|---|---|
| EP | 2251525 | A1 | 11/2010 |
| GB | 2345308 | A | 7/2000 |
| GB | 2448449 | A | 10/2008 |
| GB | 2448449 | B | 12/2008 |
| GB | 2482078 | A | 1/2012 |
| WO | 2010/039131 | A1 | 4/2010 |
| WO | 2011/023743 | A2 | 11/2011 |
| WO | 2011/137112 | A2 | 11/2011 |
| WO | 2014/014591 | A1 | 1/2014 |
| WO | 2014/100072 | A1 | 6/2014 |
| WO | 2016/160003 | A1 | 10/2016 |
| WO | 2017/151384 | A1 | 9/2017 |

OTHER PUBLICATIONS

Chakraborty et al., Drilling and Completions Services and Capabilities Presentation, Jan. 2018, Virtual Integrated Analytic Solutions, Inc., 33 pages.

Gorra et al., Expandable Zonal Isolation Barrier (ZIB) Provides a Long-Term Well Solution as a High Differential Pressure Metal Barrier to Flow, Brazilian Petroleum Technical Papers, 2010, Abstract only, 1 page.

Hinkie et al., Multizone Completion with Accurately Placed Stimulation Through Casing Wall, SPE Production and Operations Symposium, Mar. 13-Apr. 3, 2007, pp. 1-4.

Jackson et al., Slip Assembly, U.S. Appl. No. 13/361,477, filed Jan. 30, 2012.

Jackson et al., Slip Assembly, U.S. Appl. No. 14/987,255, filed Jan. 4, 2016.

Kellner et al., Downhole Tool Including a Swage, U.S. Appl. No. 29/689,996, filed May 3, 2019.

Kellner et al., Slip Segment for a Downhole Tool, U.S. Appl. No. 15/064,312, filed Mar. 8, 2016.

Kellner et al., Ball Drop Wireline Adapter Kit, U.S. Appl. No. 16/131,802, filed Sep. 14, 2018.

Martin et al., Dowhnhole Tool and Methods, U.S. Appl. No. 16/818,502, filed Mar. 13, 2020.

Kellner et al., Downhole Tool With Sleeve and Slip, U.S. Appl. No. 16/804,765, filed Feb. 28, 2020.

Kellner et al., Downhole Tool With Sealing Ring, U.S. Appl. No. 16/695,316, filed Nov. 11, 2019.

King et al., A Methodology for Selecting Interventionless Packer Setting Techniques, SPE-90678-MS, Society of Petroleum Engineers, 2004, pp. 1-3.

(56) References Cited

OTHER PUBLICATIONS

Larimore et al., Overcoming Completion Challenges with Interventionless Devices—Case Study—The "Disappearing Plug", SPE 63111, SPE International 2000, pp. 1-13.
Mailand et al., Non-Damaging Slips and Drillable Bridge Plug, U.S. Appl. No. 12/836,333, filed Jul. 14, 2010.
Martin et al., Downhole Tool With an Expandable Sleeve, U.S. Appl. No. 15/217,090, filed Jul. 22, 2016.
Martin et al., Downhole Tool With an Expandable Sleeve, U.S. Appl. No. 15/727,390, filed Oct. 6, 2017.
Martin et al., Downhole Tool With an Expandable Sleeve, U.S. Appl. No. 15/985,637, filed May 21, 2018.
Kellner et al., Deformable Downhole Tool With Dissolvable Element and Brittle Protective Layer, U.S. Appl. No. 16/677,993, filed Nov. 8, 2019.
Tonti et al., Downhole Tool With an Expandable Sleeve, Grit Material, and Button Inserts, U.S. Appl. No. 16/117,089, filed Aug. 30, 2018.
Tonti et al., Downhole Tool With Recessed Buttons, U.S. Appl. No. 16/662,792, filed Oct. 24, 2019.
Tonti, Downhole Tool With an Acid Pill, U.S. Appl. No. 17/178,517, filed Feb. 18, 2021.
Vargus et al., Completion System Allows for Interventionless Stimulation Treatments in Horizontal Wells with Multiple Shale Pay Zones, Annual SPE Technical Conference, Sep. 2008, Abstract only, 1 page.
Vargus et al., Completion System Allows for Interventionless Stimulation Treatments in Horizontal Wells with Multiple Shale Pay Zones, SPE Annual Technical Conference, Sep. 2008, pp. 1-8.
Vargus et al., System Enables Multizone Completions, The American Oil & Gas Reporter, 2009, Abstract only, 1 page.
World Oil, Slotted Liner Design for SAGD Wells ///, Jun. 2007, WorldOil.Com, https://www.worldoil.com/magazine/2007/june-2007/special-focus/slotted-liner-design-for-sagd-wells, 1 page.
Xu et al., Declaration Under 37 CFR 1.132, U.S. Appl. No. 14/605,365, filed Jan. 26, 2015, pp. 1-4.
Xu et al., Smart Nanostructured Materials Deliver High Reliability Completion Tools for Gas Shale Fracturing, SPE 146586, SPE International, 2011, pp. 1-6.
Zhang et al., High Strength Nanostructured Materials and Their Oil Field Applications, SPE 157092, SPE International, 2012, pp. 1-6.
Non-Final Office Action dated Apr. 15, 2021, U.S. Appl. No. 16/804,765, 13 pages.
Non-Final Office Action dated May 12, 2021, U.S. Appl. No. 16/818,502, 7 pages.

* cited by examiner

DOWNHOLE TOOL WITH BALL-IN-PLACE SETTING ASSEMBLY AND ASYMMETRIC SLEEVE

CROSS-REFERENCE TO RELATED APPLICATIONS

This application claims priority to U.S. Provisional Patent Application No. 62/804,046, filed on Feb. 11, 2019, the entirety of which is incorporated herein by reference.

BACKGROUND

There are various methods by which openings are created in a production liner for injecting fluid into a formation. In a "plug and perf" frac job, the production liner is made up from standard lengths of casing. Initially, the liner does not have any openings through its sidewalls. The liner is installed in the wellbore, either in an open bore using packers or by cementing the liner in place, and the liner walls are then perforated. The perforations are typically created by perforation guns that discharge shaped charges through the liner and, if present, adjacent cement.

Before or after the perforations are formed, a plug may be deployed and set into position in the liner. Some plugs include a sleeve that is expanded radially-outward into contact with the inner surface of the liner, such that the sleeve is held in place with the liner. Then, after the perforations are formed, a ball may be dropped into the wellbore so as to engage a valve seat formed in the plug. Once having received the ball, the plug thus directs fluid pumped into the wellbore outwards, through the perforations, and into the formation.

SUMMARY

A downhole tool system is disclosed. The downhole tool system includes a downhole tool. The downhole tool includes a body having a bore formed axially-therethrough. An inner surface of the body defines an asymmetric shoulder. The downhole tool also includes an upper cone configured to be received within the bore of the body from an upper axial end of the body. The upper cone is configured to move within the body in a first direction from the upper axial end toward the shoulder in response to actuation by a setting assembly, which forces at least a portion of the body radially-outward.

In another embodiment, the downhole tool system includes a downhole tool and a setting assembly. The downhole tool includes a body having a bore formed axially-therethrough. An inner surface of the body defines an asymmetric shoulder. The downhole tool also includes an upper cone configured to be received within the bore of the body from an upper axial end of the body. The downhole tool also includes a lower cone configured to be received within the bore of the body from a lower axial end of the body. The setting assembly is configured to move the upper and lower cones toward one another in the body. The setting assembly includes a first impediment configured to be received within a first seat in the upper cone.

A method for actuating a downhole tool system is also disclosed. The method includes running the downhole tool system into a wellbore. The downhole tool system includes a setting assembly and a downhole tool. The downhole tool includes a body having a bore formed axially-therethrough. An inner surface of the body defines an asymmetric shoulder. The downhole tool also includes an upper cone configured to be received within the bore of the body from an upper axial end of the body. The downhole tool also includes a lower cone configured to be received within the bore of the body from a lower axial end of the body. The method also includes exerting opposing axial forces on the upper cone and the lower cone with the setting assembly, which causes the upper cone and the lower cone to move toward the shoulder, thereby causing the body to expand radially-outward.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
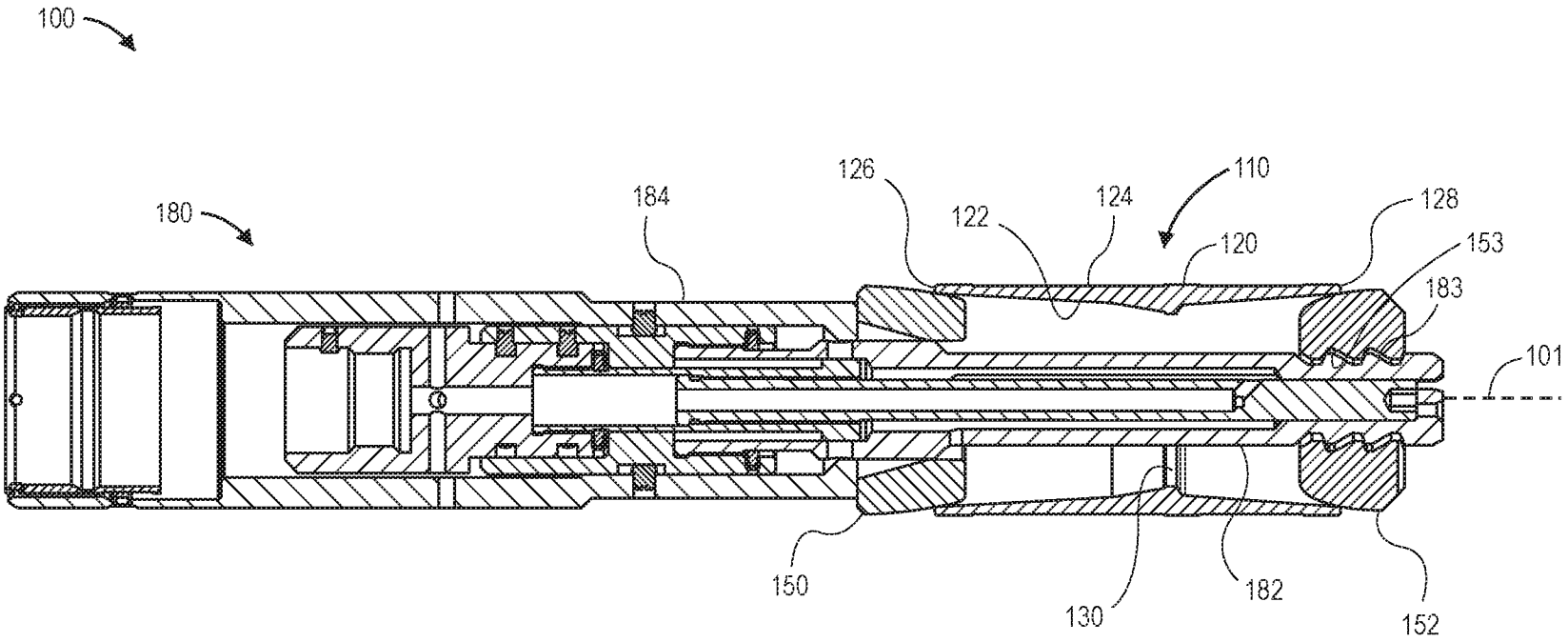
FIG. 1 illustrates a side, cross-sectional view of an asymmetric downhole tool system, including a downhole tool and a setting assembly, in a run-in configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole tool system 100 having a downhole tool 110 and a setting assembly 180, according to an embodiment. The downhole tool 110 may be or include a plug (e.g., a frac plug). As shown, the downhole tool 110 may include an annular body 120 with a bore formed axially therethrough. The body 120 may have an inner surface 122 and an outer surface 124. The body 120 may also have a first (e.g., upper) axial end 126 and a second (e.g., lower) axial end 128. As described in greater detail below, the inner surface 122 may define an asymmetric shoulder 130. The setting assembly 180 may include an inner rod 182 and an outer sleeve 184.

Figure 2A:
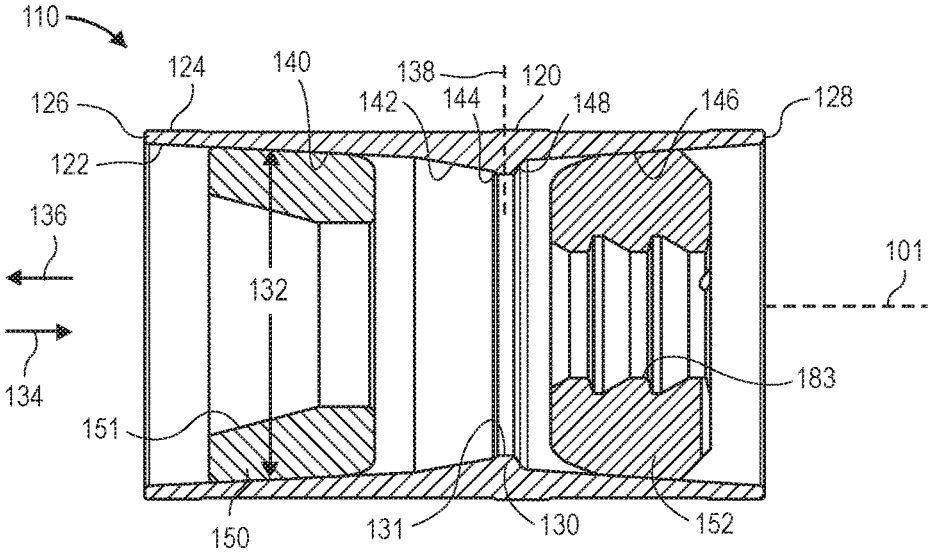
FIG. 2A illustrates a side, cross-sectional view of the downhole tool in a first set configuration, according to an embodiment.

Referring now to FIG. 2A, the inner surface 122 of the body 120 may define a first, upper, tapered portion 140. The first, upper, tapered portion 140 may extend from the upper axial end 126 of the body 120 toward the shoulder 130. Thus, as shown, an inner diameter 132 of the body 120 may decrease in the first, upper, tapered portion 140 in a direction 134 proceeding from the upper axial end 126 toward the shoulder 130. As a result, a radial thickness (e.g., between the inner surface 122 and the outer diameter surface 124 of the body 120) may increase in the first, upper, tapered portion 140 proceeding in the direction 134. The first, upper, tapered portion 140 may be oriented at an angle from about 1 degree to about 10 degrees, about 1 degree to about 7 degrees, or about 1 degree to about 5 degrees with respect to a central longitudinal axis 101 through the body 120. For example, the first, upper, tapered portion 140 may be oriented at an angle of about 3 degrees with respect to the central longitudinal axis 101.

The inner surface 122 may also define a second, upper, tapered portion 142. In at least one embodiment, the second, upper, tapered portion 142 may at least partially define an axial face of the shoulder 130. The second, upper, tapered portion 142 may extend from the first, upper, tapered portion 140 toward the shoulder 130 (or the lower axial end 128 of the body 120). Thus, as shown, the inner diameter 132 of the body 120 may decrease in the second, upper, tapered portion 142 proceeding in the direction 134. As a result, the radial thickness may increase in the second, upper, tapered portion 142 proceeding in the direction 134. The second, upper, tapered portion 142 may be oriented at a different (e.g., larger) angle than the first, upper, tapered portion 140. For example, the second, upper, tapered portion 142 may be oriented at an angle from about 3 degrees to about 20 degrees, about 5 degrees to about 15 degrees, or about 8 degrees to about 12 degrees with respect to the central longitudinal axis 101 through the body 120. For example, the second, upper, tapered portion 142 may be oriented at an angle of about 10 degrees with respect to the central longitudinal axis 101.

The inner surface 122 may also define a third, upper, tapered portion 144. In at least one embodiment, the third, upper, tapered portion 144 may also and/or instead at least partially define the axial face of the shoulder 130. For example, the third, upper, tapered portion 144 may serve as a stop surface of the shoulder 130. The third, upper, tapered portion 144 may extend from the second, upper, tapered portion 142 toward the shoulder 130 (or the lower axial end 128 of the body 120). Thus, as shown, the inner diameter 132 of the body 120 may decrease in the third, upper, tapered portion 144 proceeding in the direction 134. As a result, the radial thickness may increase in the third, upper, tapered portion 144 proceeding in the direction. The third, upper, tapered portion 144 may be oriented at a different (e.g., larger) angle than the first, upper, tapered portion 140 and/or the second, upper, tapered portion 142. For example, the third, upper, tapered portion 144 may be oriented at an angle from about 15 degrees to about 75 degrees, about 20 degrees to about 60 degrees, or about 25 degrees to about 40 degrees with respect to the central longitudinal axis 101 through the body 120. For example, the third, upper, tapered portion 144 may be oriented at an angle of about 45 degrees with respect to the central longitudinal axis 101.

The inner surface 122 may also define a fourth, lower, tapered portion 146. The fourth, lower, tapered portion 146 may extend from the lower axial end 128 of the body 120 toward the shoulder 130. Thus, as shown, an inner diameter 132 of the body 120 may decrease in the fourth, lower, tapered portion 146 proceeding in a direction 136 (e.g., opposite to the direction 134). As a result, the radial thickness may increase in the fourth, lower, tapered portion 146 proceeding in the direction 136. The fourth, lower, tapered portion 146 may be oriented at an angle from about 1 degree to about 10 degrees, about 1 degree to about 7 degrees, or about 1 degree to about 5 degrees with respect to the central longitudinal axis 101 through the body 120. For example, the fourth, lower, tapered portion 146 may be oriented at an angle of about 3 degrees with respect to the central longitudinal axis 101.

The inner surface 122 may define also a fifth, lower, tapered portion 148. In at least one embodiment, the fifth, lower, tapered portion 148 may at least partially define an opposing axial face of the shoulder 130 (from the second, upper, tapered portion 142 and/or the third, upper, tapered portion 144). The fifth, lower, tapered portion 148 may extend from the fourth, lower, tapered portion 146 toward the shoulder 130 (and/or the upper axial end 126 of the body 120). Thus, as shown, the inner diameter 132 of the body 120 may decrease in the fifth, lower, tapered portion 148 proceeding in the direction 136. As a result, the radial thickness may increase in the fifth, lower, tapered portion 148 proceeding in the direction 136. The fifth, lower, tapered portion 148 may be oriented at a different (e.g., larger) angle than the fourth, lower, tapered portion 146. For example, the fifth, lower, tapered portion 148 may be orientated at an angle from about 15 degrees to about 75 degrees, about 20 degrees to about 60 degrees, or about 25 degrees to about 40 degrees with respect to the central longitudinal axis 101 through the body 120. For example, the fifth, lower, tapered portion 148 may be oriented at an angle of about 45 degrees with respect to the central longitudinal axis 101.

A flat surface 131 may also at least partially define the shoulder 130. The flat surface 131 may extend between the third, upper, tapered portion 144 and the fifth, lower, tapered portion 148. The flat surface 131 may be substantially parallel with the central longitudinal axis 101. In some embodiments, the flat surface 131 may be oriented at an angle to the central longitudinal axis 101, may be substituted with a curved surface, or may be omitted, e.g., such that the third, upper, tapered portion 144 meets with the fifth, lower, tapered surface 148 at an edge (e.g., a point, in cross-section).

Thus, as may be seen, the shoulder 130, which may be at least partially defined by the second, upper, tapered portion 142, the third, upper, tapered portion 144, the fifth, lower, tapered portion 148, or a combination thereof, may be asymmetric. The shoulder 130 may be asymmetric with respect to a plane 138 that extends through the shoulder 130 and is perpendicular to the central longitudinal axis 101. Further, the body 120 may be asymmetric, at least because the shoulder 130 (e.g., the radially-innermost extent thereof) may be closer to the lower axial end 128 than the upper axial end 126.

The downhole tool 100 may further include upper and lower cones 150, 152. The upper cone 150 may be received into the upper axial end 126 of the body 120, and the lower cone 152 may be received in the lower axial end 128 of the body 120. The upper and lower cones 150, 152 may each have a bore formed axially-therethrough, through which the rod 182 (see FIG. 1) may extend. As described below, the upper and lower cones 150, 152 may be adducted together to force the body 120 radially-outward and into engagement with a surrounding tubular (e.g., a liner or casing). The upper end of the upper cone 150 may define a valve seat 151, which may be configured to catch and at least partially form a seal with a ball or another obstructing impediment.

Figure 3:
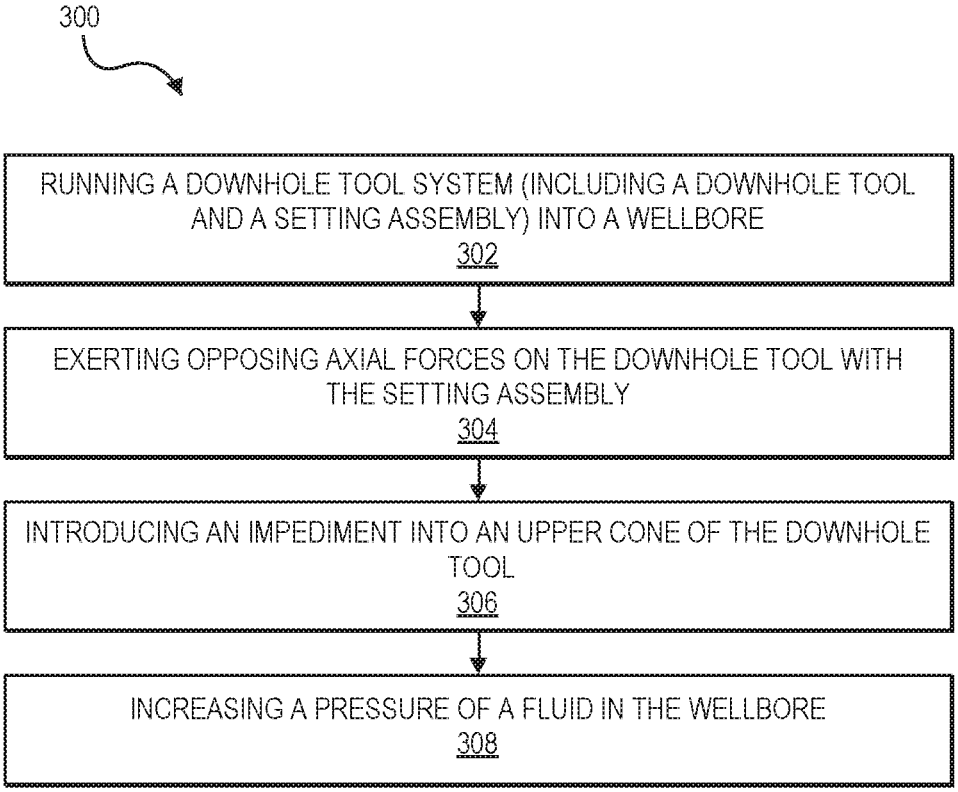
FIG. 3 illustrates a flowchart of a method for actuating the downhole tool system, according to an embodiment.

FIG. 3 illustrates a flowchart of a method 300 for actuating the downhole tool system 100, according to an embodiment. The method 300 may include running the downhole tool system 100 into a wellbore, as at 302.

The method 300 may also include exerting opposing axial forces on the downhole tool 110 with the setting assembly 180, as at 304. More particularly, the outer sleeve 184 may exert a downward (e.g., pushing) force on the upper cone 150, and the rod 182 may exert an upward (e.g., pulling) force on the lower cone 152. This may cause the cones 150, 152 to move axially-toward each other within the body 120. In other words, an axial distance between the cones 150, 152 may decrease.

The force exerted by the outer sleeve 184 may cause the upper cone 150 to move within the first, upper, tapered portion 140 and/or the second, upper, tapered portion 142 of the body 120, which may force an upper portion of the body 120 to radially-outward (e.g., deforming or otherwise expanding the upper portion of the body 120). Similarly, the force exerted by the rod 182 may cause the lower cone 152 to move within the fourth, lower, tapered portion 146 and/or the fifth, lower, tapered portion 148 of the body 120, which may force (e.g., deform or otherwise expand) a lower portion the body 120 radially-outward In at least one embodiment, some portions of the body 120 may be forced outwards more or less than others. For example, the portions of the body 120 that are axially-aligned with the cones 150, 152 may be forced radially-outward farther than the portions of the body 120 that are not axially-aligned with the cones 150, 152. For example, an intermediate (e.g., middle) portion of the body 120 may be forced to move radially-outward less than the portions on either side thereof that are axially-aligned with the cones 150, 152.

When the force(s) exerted by the rod 182 and/or the outer sleeve 184 reach or exceed a predetermined setting force, the setting assembly 180 may disengage from the downhole tool 110 and be pulled back to the surface. In one embodiment, this may include the rod 182 disengaging from the lower cone 152. As shown, the lower cone 152 may have teeth 153 that engage corresponding teeth 183 of the rod 182, and the teeth 153 and/or 183 may break or yield, allowing the rod 182 to separate from and be pulled upward through the body 120 and the cones 150, 152. For example, the teeth 153 of the lower cone 152 may be made of a softer material (e.g., magnesium) than the teeth 183 of the rod 182, allowing the teeth 153 to break or yield before the teeth 183. In another example, a portion of another component that couples the setting assembly 180 (e.g., the rod 182) to the downhole tool 110 (e.g., the lower cone 152) may break or yield, allowing the rod 182 to separate from and be pulled upward through the body 120 and the cones 150, 152. The predetermined setting force may be selected such that the upper cone 150 is left positioned within the first, upper, tapered portion 140 or the second, upper, tapered portion 142 (but not in the third, upper, tapered portion 144), and the lower cone 152 is left positioned within the fourth, lower, tapered portion 146 (but not the fifth, lower, tapered portion 148).

Figure 2B:
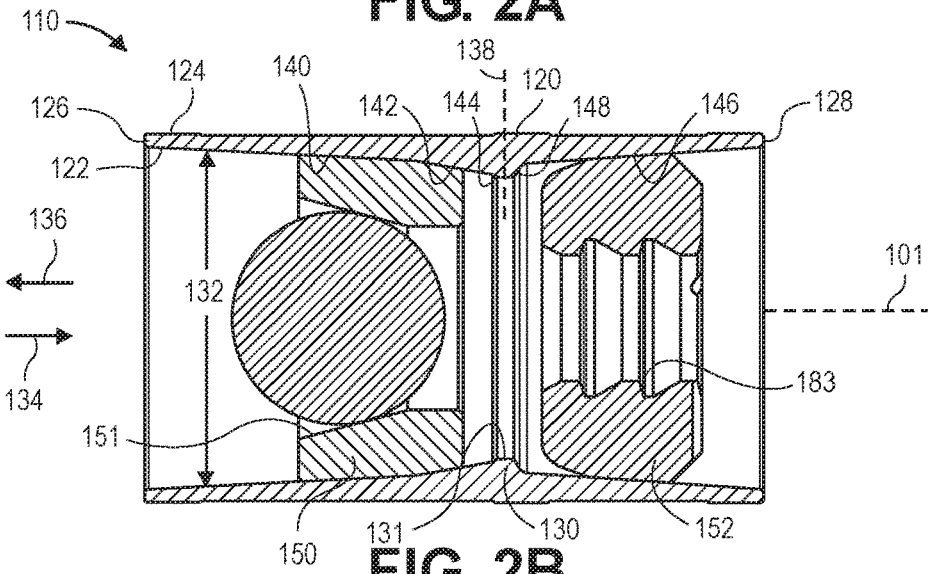
FIG. 2B illustrates a side-cross sectional view of the downhole tool in a second set configuration, according to an embodiment.

The method 300 may also include introducing an impediment (e.g., a ball) 190 into the upper cone 150, as at 306. This is shown in FIG. 2B. The ball 190 may be introduced from the surface and be pumped down through the wellbore (e.g., by a pump at the surface). Alternatively, the ball 190 may be run into the wellbore together with the downhole tool system 100. For example, the ball 190 may be coupled to or positioned within the downhole tool system 100 when the downhole tool system 100 is run into the wellbore. The ball 190 may be received into the seat 151 of the upper cone 150.

The method 300 may also include increasing a pressure of a fluid in the wellbore, as at 308. The pressure may be increased between the surface and the ball 190 by the pump at the surface. Increasing the pressure may exert a downhole force on the upper cone 150 and the ball 190 (e.g., toward the shoulder 130). The force from the pressure/ball 190 may be greater than the force previously exerted by the outer sleeve 184, and may thus cause the upper cone 150 to move farther toward the shoulder 130. For example, the force from the pressure/ball 190 may cause the upper cone 150 to move from the first, upper, tapered portion 140 at least partially into (or into contact with) the second, upper, tapered portion 142, which, by virtue of having a larger taper angle than the first, upper, tapered portion 140, requires a larger force for the upper cone 150 to move therein. As the upper cone 150 is moved farther into the body 120 under force of the pressure/ball 190, more of the body 120 may be forced radially-outward as the upper cone 150 moves into the second, upper, tapered portion 142. In some embodiments, the upper cone 150 may not travel all the way to the third, upper, tapered portion 144; however, in other embodiments, the upper cone 150 may be pressed into engagement with the third, upper, tapered portion 144. The third, upper, tapered portion 144 may thus act as a stop that prevents further axial movement of the upper cone 150.

Before, during, or after reaching the second and/or third, upper, tapered, portion 142, 144, the downhole tool 110 is set in the wellbore against the surrounding tubular, and the ball 190 is in the seat 151, which prevents fluid from flowing (e.g., downward) through the downhole tool 110 and ball 190. The subterranean formation may then be fractured above the downhole tool 110.

Figure 2C:
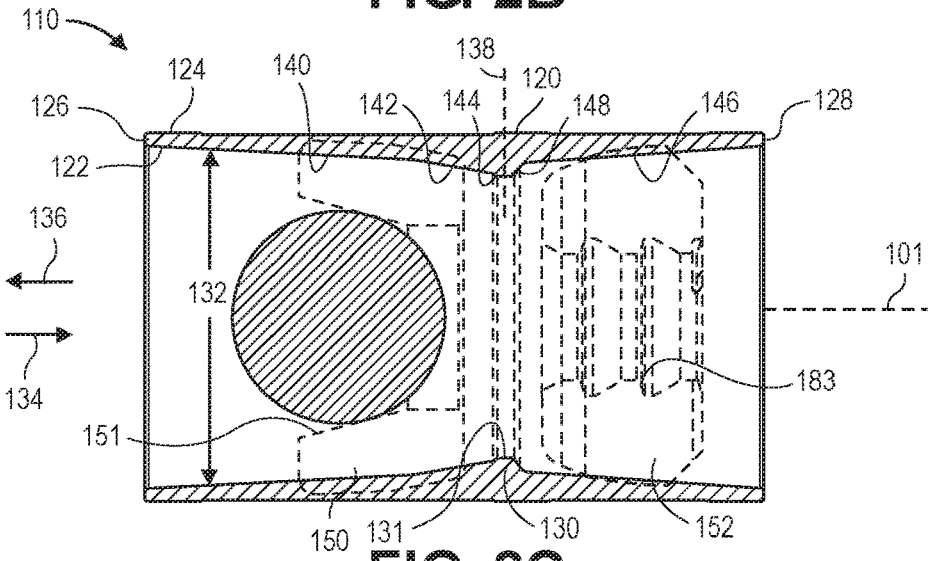
FIG. 2C illustrates a side, cross-sectional view of a body of the downhole tool in the first set configuration and cones of the downhole tool in the second set configuration, according to an embodiment.

FIG. 2C illustrates a side, cross-sectional view of the downhole tool 110 with the body 120 in the first set configuration (from FIG. 2A) and the cones 150, 152 in the second set configuration (from FIG. 2B), according to an embodiment. Thus, the cones 150, 152 are shown overlapping/superimposing the body 120. As will be appreciated, this is a configuration that cannot actually happen, but FIG. 2C is provided to illustrate how the movement of the cones 150, 152 will force the body 120 radially-outward.

Figure 4:
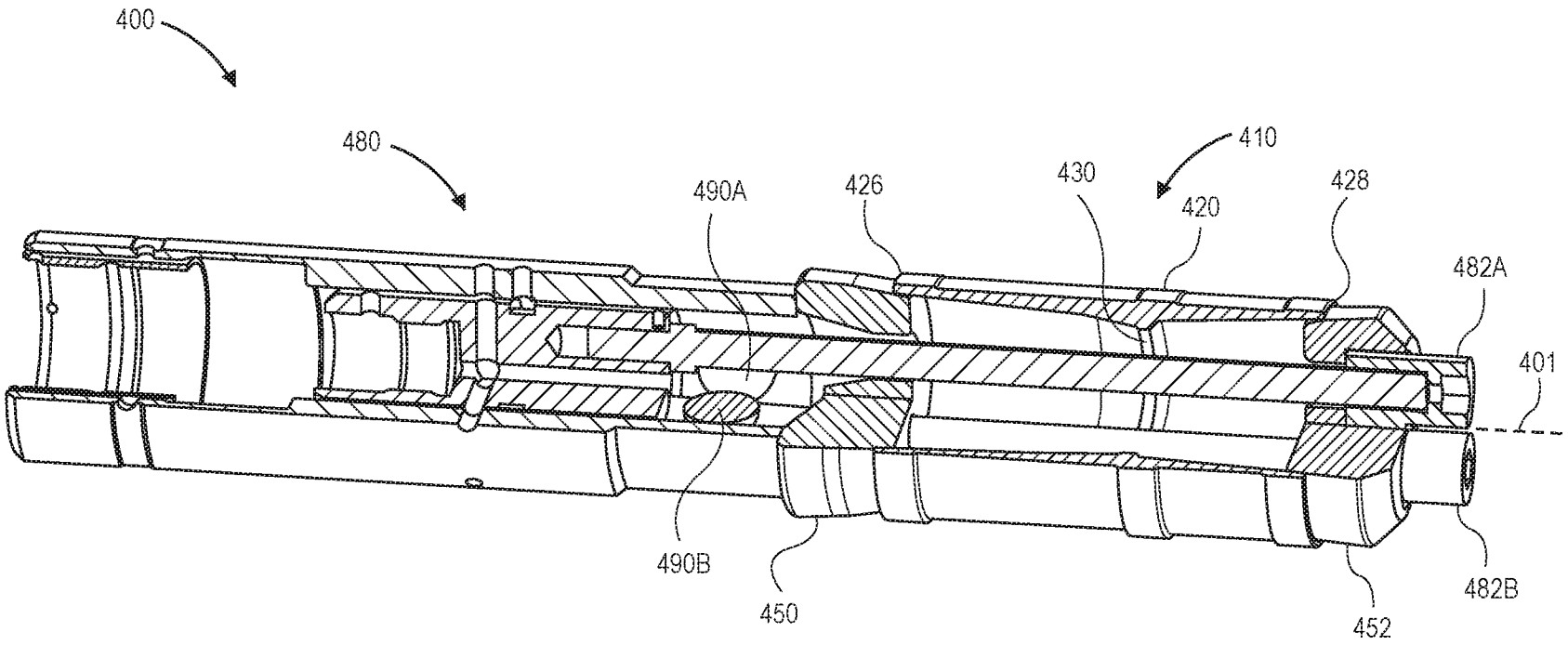
FIG. 4 illustrates a quarter-sectional, perspective view of another asymmetric downhole tool system, including a downhole tool and a ball-in-place setting assembly, in a run-in configuration, according to an embodiment.
Figure 5:
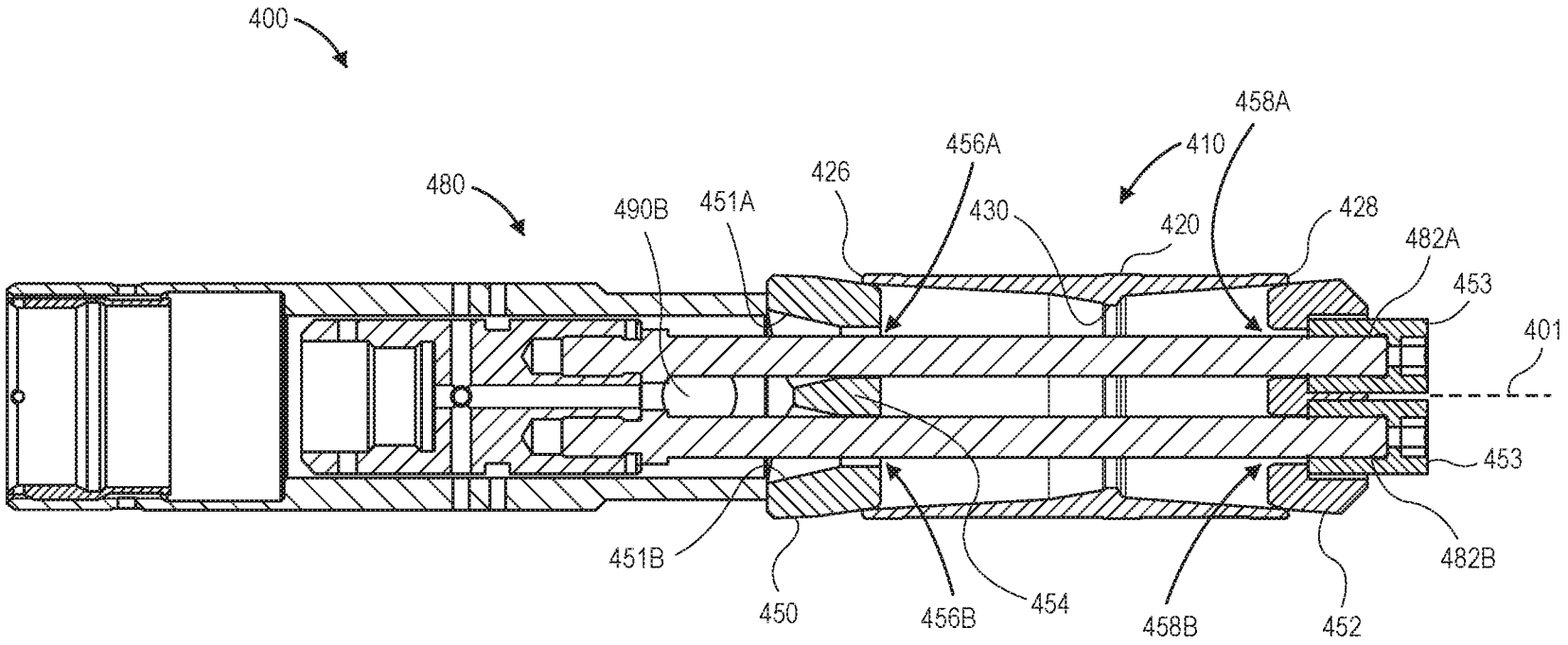
FIG. 5 illustrates a side, cross-sectional view of the downhole tool system of FIG. 4 in the run-in configuration, according to an embodiment.

FIG. 4 illustrates a quarter-sectional, perspective view of another downhole tool system 400 in a first (e.g., run-in) configuration, according to an embodiment. FIG. 5 illustrates a side, cross-sectional view of the downhole tool system 400 in the run-in configuration, according to an embodiment. The downhole tool system 400 may include a downhole tool 410 and a setting assembly 480. The downhole tool 410 may be or include a plug (e.g., a frac plug). As shown, the downhole tool 410 may include an annular body 420 with a bore formed axially-therethrough. In at least one embodiment, the body 420 may be similar to (or the same as) the body 120 discussed above. For example, the body 420 may include an asymmetric shoulder 430. The body 420 may also include one or more of the tapered portions 140, 142, 144, 146, 148 from FIGS. 1-3, although they are not labeled in FIGS. 4 and 5.

The downhole tool 410 may further include upper and lower cones 450, 452. The upper cone 450 may be received into an upper axial end 426 of the body 420, and the lower cone 452 may be received in a lower axial end 428 of the body 420. The upper and lower cones 450, 452 may each have one or more bores formed axially-therethrough. As shown, the upper and lower cones 450, 452 may each include two bores 456A, 456B, 458A, 458B formed axially-therethrough, which may be circumferentially-offset from one another around the central longitudinal axis 401 (e.g., by 180 degrees). As described below, the upper and lower cones 450, 452 may be adducted together to force the body 420 radially-outward and into engagement with a surrounding tubular (e.g., liner or casing). The upper end of the upper cone 450 may define one or more seats (two are shown: 451A, 451B). The seats 451A, 451B may define at least a portion of the bores formed through the upper cone 450.

The setting assembly 480 may include two or more inner rods (two are shown: 482A, 482B) and an outer sleeve 484. The first rod 482A may extend through the first bore 456A in the upper cone 450 and the first bore 458A in the lower cone 452, and the second rod 482B may extend through the second bore 456B in the upper cone 450 and the second bore 458B in the lower cone 452. The rods 482A, 482B may be coupled to (or otherwise held in place with respect to) the downhole tool 410 using any of the configurations described above with respect to FIGS. 1-3. As shown, the rods 482A, 482B may be coupled to (or otherwise held in place with respect to) the lower cone 452 by shear members (nuts or caps) 453. The shear members 453 may be positioned at least partially between the rods 482A, 482B and the lower cone 452 and be configured to shear or break to release the setting assembly 480 (e.g., the rods 482A, 482B) from the downhole tool 410 (e.g., the lower cone 452) when exposed to a predetermined setting force.

One or more impediments (two are shown: 490A, 490B) may be positioned at least partially within the downhole tool system 400 when the downhole tool system 400 is run into a wellbore. More particularly, the impediments 490A, 490B may be positioned at least partially within the outer sleeve 484 of the setting assembly 480 when the downhole tool system 400 is run into the wellbore. As shown, the impediments 490A, 490B may be circumferentially-offset from one another (e.g., by 180 degrees) and/or circumferentially between the rods 482A, 482B around the central longitudinal axis 401. Further, the impediments 490A, 490B may be positioned above the upper cone 450.

In an embodiment, the impediments 490A, 490B may be spherical balls. The balls 490A, 490B may be sized and shaped to fit within the seats 451A, 451B in the upper cone 450. The upper cone 450 may include a central divider 454, which may have a pointed or otherwise narrowed or radiused upper end, so as to direct the balls 490A, 490B into the seats 451A, 451B. Although two seats 451A, 451B and two balls 490A, 490B are shown, in other embodiments, additional balls may be provided within the downhole tool system 400 to provide a redundancy in the event that the balls 490A, 490B do not properly move into the seats 451A, 451B.

Figure 6:
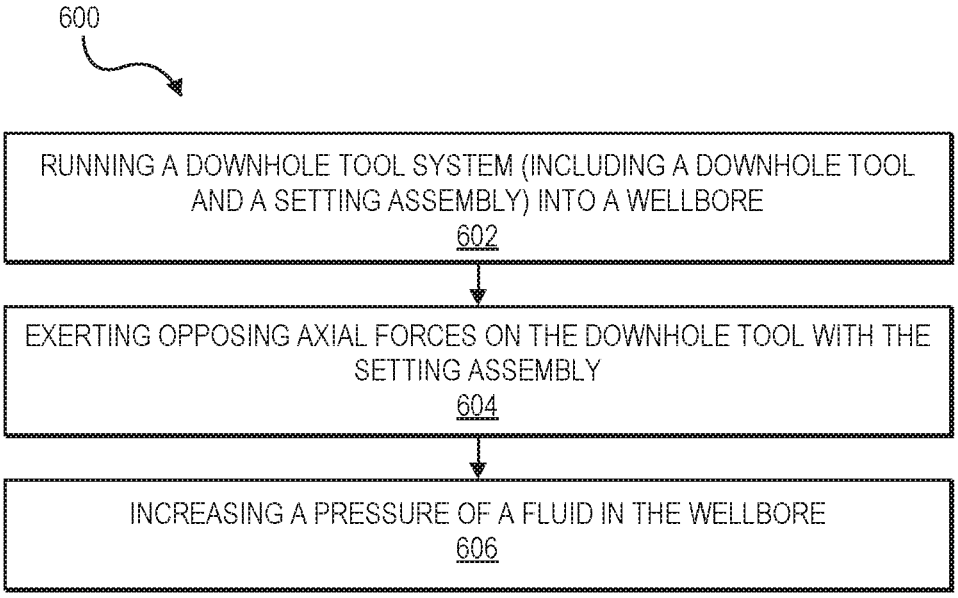
FIG. 6 illustrates a flowchart of a method for actuating the downhole tool system of FIG. 4, according to an embodiment.

FIG. 6 illustrates a flowchart of a method 600 for actuating the downhole tool system 400, according to an embodiment. The method 600 may include running the downhole tool system 400 into a wellbore, as at 602.

The method 600 may also include exerting opposing axial forces on the downhole tool 410 with the setting assembly 480, as at 604. More particularly, the outer sleeve 484 may exert a downward (e.g., pushing) force on the upper cone 450, and the rods 482A, 482B may exert an upward (e.g., pulling) force on the lower cone 452. This may cause the cones 450, 452 to move axially-toward each other within the body 420. In other words, an axial distance between the cones 450, 452 may decrease.

Figure 7:
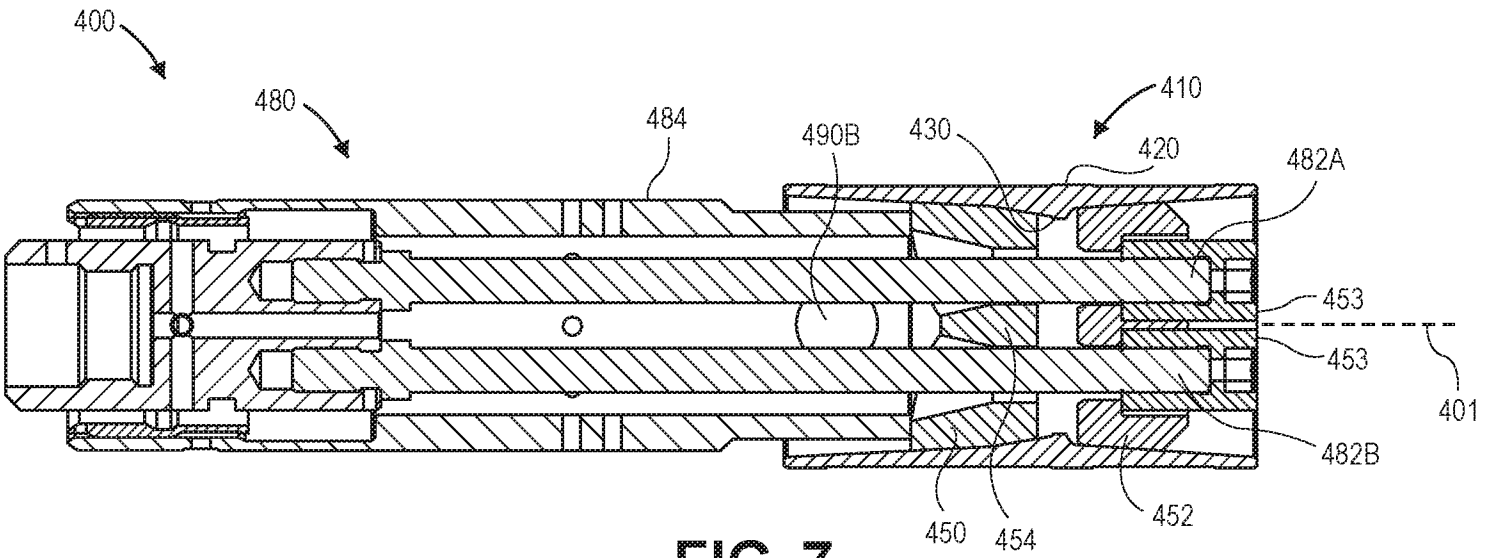
FIG. 7 illustrates a side, cross-sectional view of the downhole tool system of FIG. 4, in a first set configuration, according to an embodiment.

The force exerted by the outer sleeve 484 may cause the upper cone 450 to move within the body 420, as described above with respect to FIGS. 1-3, which may force the body 420 radially-outward. Thus, the upper cone 450 may be positioned in the first, upper, tapered portion and/or the second, upper, tapered portion when the predetermined setting force is reached, as described above. Similarly, the force exerted by the rods 482A, 482B may cause the lower cone 452 to move within the body 420, as described above with respect to FIGS. 1-3, which may force (e.g., deform or otherwise expand) the body 420 radially-outward. This is shown in FIG. 7.

When the force(s) exerted by the rods 482A, 482B and/or the outer sleeve 484 reach or exceed the predetermined setting force, the setting assembly 480 may disengage from the downhole tool 410 and be pulled back to the surface. In the example shown, in response to the predetermined setting force being reached or exceeded, the shear member(s) 453 may shear or break, allowing the rods 482A, 482B to separate from and be pulled upward through the body 420 and the cones 450, 452.

Figure 8:
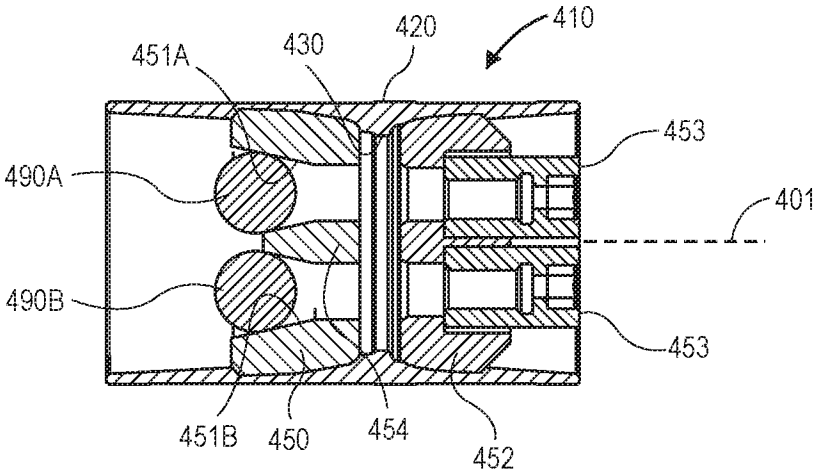
FIG. 8 illustrates a side, cross-sectional view of a portion of the downhole tool of FIG. 4 in a second set configuration, after the setting assembly has been disconnected and removed, according to an embodiment.

Once the rods 482A, 482B are removed from the bores in the upper cone 450, the balls 490A, 490B may be free to move into the seats 451A, 451B. This is shown in FIG. 8. The balls 490A, 490B may move into the seats 451A, 451B substantially simultaneously (e.g., within 5 seconds or less from one another) and/or be positioned within the seats 451A, 451B substantially simultaneously. When the downhole tool system 400 is in a substantially vertical portion of the wellbore, the balls 490A, 490B may descend into the seats 451A, 451A due to gravity. In another example, when the downhole tool system 400 is in a substantially horizontal portion of the wellbore, the pump at the surface may cause fluid to flow (e.g., downward) through the wellbore, which may carry the balls 490A, 490B into the seats 451A, 451B. Because the balls 490A, 490B are run into the wellbore with the downhole tool system 400, and thus only need to move a short distance to reach the seats 451A, 451B, only a minimal amount of fluid needs to be pumped to carry the balls 490A, 490B to the seats 451A, 451B. The short distance may be from about 1 cm to about 100 cm, about 5 cm to about 75 cm, or about 10 cm to about 50 cm. As will be appreciated, the aforementioned minimal amount of fluid is significantly less than the amount of fluid needed to pump a ball down from the surface, as is done for conventional tools. The amount of time that the pump is run is thus also significantly less.

The method 600 may also include increasing a pressure of a fluid in the wellbore, as at 606. The pressure may be increased between the surface and the balls 490A, 490B by the pump at the surface. For example, the pump may start running to move the balls 490A, 490B into the seats 451A, 451B, and then continue running to increase the pressure. Increasing the pressure may exert a (e.g., downward) force on the upper cone 450 (e.g., toward the shoulder 430). The force from the pressure/balls 490A, 490B may be greater than the force previously exerted by the outer sleeve 484, and may thus cause the upper cone 450 to move farther toward the shoulder 430, as described above with respect to FIGS. 1-3. As will be appreciated, the body 420 may be forced even farther radially-outward when the upper cone 450 moves farther toward the shoulder 430.

At this point, the downhole tool 410 is set in the wellbore against the surrounding tubular, and the balls 490A, 490B are in the seats 451A, 451B, which prevents fluid from flowing (e.g., downward) through the downhole tool 410. The subterranean formation may then be fractured above the downhole tool 410. Any of the components of the downhole tool systems 100, 400 (e.g., cones, bodies, obstruction members, etc.) may be made from a dissolvable material such as magnesium.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool system, comprising:

a downhole tool comprising:

a body having a bore formed axially-therethrough, wherein an inner surface of the body defines an asymmetric shoulder, wherein the inner surface comprises first, second, and third upper, tapered portions each having inner diameters that decrease proceeding in a first direction, and wherein a second angle of the second upper, tapered portion is greater than a first angle of the first upper, tapered portion and less than a third angle of the third upper, tapered portion with respect to a central longitudinal axis through the body; and an upper cone configured to be received within the bore of the body from an upper axial end of the body, wherein the upper cone is configured to move within the body in the first direction from the upper axial end toward the shoulder in response to actuation by a setting assembly, which forces at least a portion of the body radially-outward.

2. The downhole tool system of claim 1, wherein the upper cone is configured to move farther within the body in the first direction in response to an impediment being received in the upper cone and a pressure of a fluid above the impediment increasing.

3. The downhole tool system of claim 2, wherein the impediment is positioned within the downhole tool system when the downhole tool system is run into a wellbore.

4. The downhole tool system of claim 1, wherein the shoulder is positioned closer to a lower axial end of the body than the upper axial end of the body.

5. The downhole tool system of claim 1, wherein the shoulder is asymmetric with respect to a plane that extends through the shoulder, and wherein the plane is perpendicular to the central longitudinal axis.

6. The downhole tool system of claim 1, wherein the third upper, tapered portion defines at least a portion of the shoulder.

7. The downhole tool system of claim 1, wherein the upper cone is configured to move within the first upper, tapered portion in the first direction in response to actuation by the setting assembly, and wherein the upper cone is configured to move within the second upper, tapered portion in the first direction in response to an impediment being received in the upper cone and a pressure of a fluid above the impediment increasing.

8. The downhole tool system of claim 1, further comprising the setting assembly, wherein the setting assembly is configured to disengage with the downhole tool in response to a predetermined setting force, and wherein the upper cone is configured to be positioned within the first upper, tapered portion when the predetermined setting force is reached.

9. The downhole tool system of claim 1, further comprising the setting assembly, wherein the setting assembly is configured to disengage with the downhole tool in response to a predetermined setting force, and wherein the upper cone is configured to be positioned within the second upper, tapered portion when the predetermined setting force is reached.

10. The downhole tool system of claim 1, wherein the inner surface of the body further comprises:

a fourth lower, tapered portion, wherein the inner diameter of the body in the fourth lower, tapered portion decreases proceeding in a second direction from a lower axial end of the body toward the shoulder, and wherein the fourth lower, tapered portion is oriented at a fourth angle with respect to the central longitudinal axis through the body; and a fifth lower, tapered portion, wherein the inner diameter of the body in the fifth lower, tapered portion decreases proceeding in the second direction, and wherein the fifth lower, tapered portion is oriented at a fifth angle with respect to the central longitudinal axis that is greater than the fourth angle.

11. The downhole tool system of claim 10, wherein the downhole tool further comprises a lower cone that is configured to be received within the bore of the body from a lower axial end of the body, and wherein the lower cone is configured to move within the fourth lower, tapered portion in a second direction from a lower axial end of the body toward the shoulder in response to actuation by the setting assembly.

12. A downhole tool system, comprising:

a downhole tool comprising:

a body having a bore formed axially-therethrough, wherein an inner surface of the body defines an asymmetric shoulder;

an upper cone configured to be received within the bore of the body from an upper axial end of the body; and a lower cone configured to be received within the bore of the body from a lower axial end of the body; and a setting assembly configured to move the upper and lower cones toward one another in the body, the setting assembly comprising first and second impediments configured to be received within first and second seats in the upper cone at least partially in response to the setting assembly disengaging from the downhole tool.

13. The downhole tool system of claim 12, wherein the upper and lower cones progressively expand the body radially outwards as the upper and lower cones move toward the shoulder.

14. The downhole tool system of claim 13, wherein the upper cone is configured to move farther toward the shoulder in response to the first impediment being received in the upper cone and a pressure of a fluid above the impediment increasing, which causes the body to expand farther radially-outward.

15. The downhole tool system of claim 12, wherein the first impediment is configured to be received in the first seat after the setting assembly disengages from the downhole tool.

16. The downhole tool system of claim 12, wherein the second impediment is positioned within the downhole tool system when the downhole tool system is run into the wellbore.

17. The downhole tool system of claim 16, wherein the first and second impediments are configured to be received in the first and second seats, respectively, substantially simultaneously after the setting assembly disengages from the downhole tool.

18. The downhole tool system of claim 16, wherein the setting assembly further comprises:

a first rod configured to extend through the first seat in the upper cone and at least partially through the lower cone;

a second rod configured to extend through the second seat in the upper cone and at least partially through the lower cone, wherein the first and second rods are configured to exert an axial force on the lower cone in a direction toward the upper cone; and a sleeve configured to exert an axial force on the upper cone in a direction toward the lower cone.

19. The downhole tool system of claim 18, wherein the first and second impediments are positioned within the sleeve and at least partially between the first and second rods.

20. A method for actuating a downhole tool system, comprising:

running the downhole tool system into a wellbore, wherein the downhole tool system comprises:

a setting assembly; and a downhole tool, wherein the downhole tool comprises:

a body having a bore formed axially-therethrough, wherein an inner surface of the body defines an asymmetric shoulder;

an upper cone configured to be received within the bore of the body from an upper axial end of the body; and a lower cone configured to be received within the bore of the body from a lower axial end of the body; and exerting opposing axial forces on the upper cone and the lower cone with the setting assembly, which causes the upper cone and the lower cone to move toward the shoulder, thereby causing the body to expand radially-outward, wherein the setting assembly is configured to disengage from the downhole tool when the opposing axial forces reach a predetermined setting force, and wherein first and second impediments are configured to be received within first and second seats in the upper cone after the setting assembly disengages.

21. The method of claim 20, further comprising increasing a pressure of a fluid in the wellbore, which exerts a force on the upper cone and the first and second impediments that causes the upper cone to move farther toward the shoulder, which causes the body to expand farther radially-outward.

22. The method of claim 21, wherein the setting assembly is engaged with the lower cone via one or more shear members, and wherein the one or more shear members break in response to the predetermined setting force to allow the setting assembly to disengage from the lower cone.

23. The method of claim 20, wherein the first and second impediments are positioned within the downhole tool system when the downhole tool system is run into the wellbore.

* * * * *